US009604377B2

(12) United States Patent
Tong

(10) Patent No.: US 9,604,377 B2
(45) Date of Patent: Mar. 28, 2017

(54) SAFETY RAZOR BLADE EQUIPPED WITH MULTIPLE PROTUBERANCES

(71) Applicant: Kun Yuan Tong, Suwanee, GA (US)

(72) Inventor: Kun Yuan Tong, Suwanee, GA (US)

(73) Assignee: Kun Yuan Tong, Suwanee, GA (US)

( * ) Notice: Subject to any disclaimer, the term of this patent is extended or adjusted under 35 U.S.C. 154(b) by 254 days.

(21) Appl. No.: 14/121,203

(22) Filed: Aug. 11, 2014

(65) Prior Publication Data

US 2016/0039104 A1 Feb. 11, 2016

(51) Int. Cl.
*B26B 21/22* (2006.01)
*B26B 21/56* (2006.01)

(52) U.S. Cl.
CPC ..... *B26B 21/56* (2013.01); *B26B 21/22* (2013.01)

(58) Field of Classification Search
CPC ..... B26B 21/18; B26B 21/22; B26B 21/222; B26B 21/56
USPC ..... 30/346.1
See application file for complete search history.

(56) References Cited

U.S. PATENT DOCUMENTS 1,879,961 A * 9/1932 Thompson ..... B26B 21/54 30/346.5
2,138,063 A * 11/1938 Hotson ..... B26B 21/18 30/346.61
3,262,206 A * 7/1966 Tomek ..... A61B 5/1405 30/346
5,133,131 A * 7/1992 Hoffman ..... B26B 21/222 30/47
5,276,967 A * 1/1994 Ferraro ..... B26B 21/4068 30/32
5,329,700 A * 7/1994 Ferraro ..... B26B 21/56 30/41
7,676,929 B2 * 3/2010 Lembke ..... B26B 21/22 30/346.57
2003/0159291 A1 * 8/2003 Clark ..... B26B 21/227 30/50
2009/0056141 A1 * 3/2009 Barry ..... A45D 27/29 30/41.7
2010/0170094 A1 * 7/2010 Hayashi ..... B26B 21/225 30/50

FOREIGN PATENT DOCUMENTS

FR 634292 A * 2/1928 ..... B26B 21/18

* cited by examiner

*Primary Examiner* — Joshua Kennedy
(74) *Attorney, Agent, or Firm* — Guosheng Wang; United States Research and Patent Firm

(57) ABSTRACT

When two conventional safety razor double-edged blades are superposed on top of each other, there is no space in between them to pass the shaving residues. The presently invented safety razor double-edged blade is equipped with several spaced protuberances on its surface. When two of these present invented blades are overlapped, there is a space between them to pass the shaving residues to be rinsed away by running water. Therefore two, three or more of them can be superposed on a single razor blade holder to allow the user to experience all the benefits of a multi-blade razor cartridge in a safety razor blade system.

4 Claims, 3 Drawing Sheets

11

SAFETY RAZOR BLADE EQUIPPED WITH MULTIPLE PROTUBERANCES

THE BACKGROUND OF THE INVENTION

When two conventional safety razor blades are installed on a single razor blade holder, they lay on top of each other with no space between the two blades to allow the shaving residues to pass and essentially act as one thick blade. The presently invented safety razor blade equipped with multiple protuberances can create a space between two safety razor blades to allow the shaving residues to pass and allow the user to experience all the benefits of a multi-blade razor cartridge in a safety razor blade system.

THE BRIEF DESCRIPTION OF THE INVENTION

When two presently invented safety razor blades equipped with multiple protuberances are overlapped together there is a space in between them because the built-in protuberances act as spacers to create space in between the blades. Therefore two or more of the blades can be stacked together on a single safety razor blade holder in order to achieve the benefits of a multi-blade razor cartridge in a safety razor blade system.

THE BRIEF DESCRIPTION OF DRAWINGS

THE DETAILED DESCRIPTION OF THE INVENTION

Figure 1:
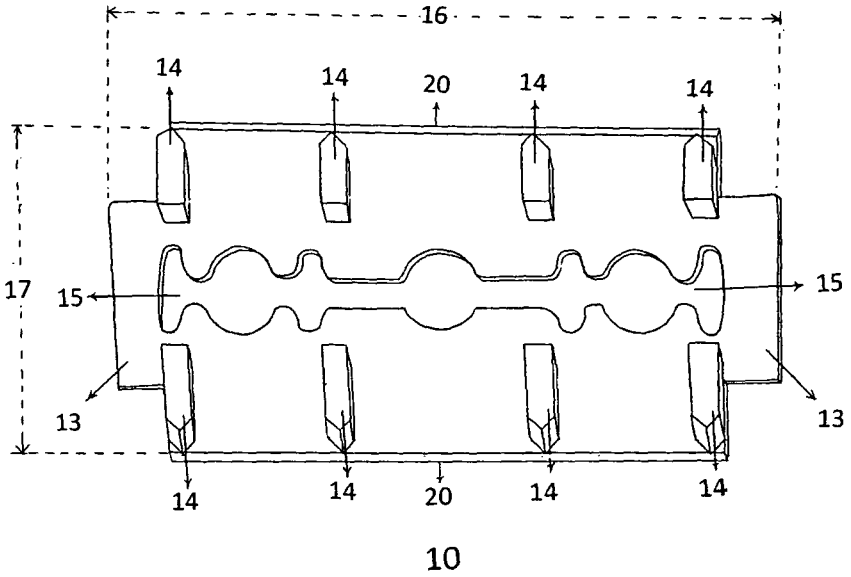
FIG. 1 is a perspective view of a safety razor blade equipped with multiple protuberances.
Figure 2:
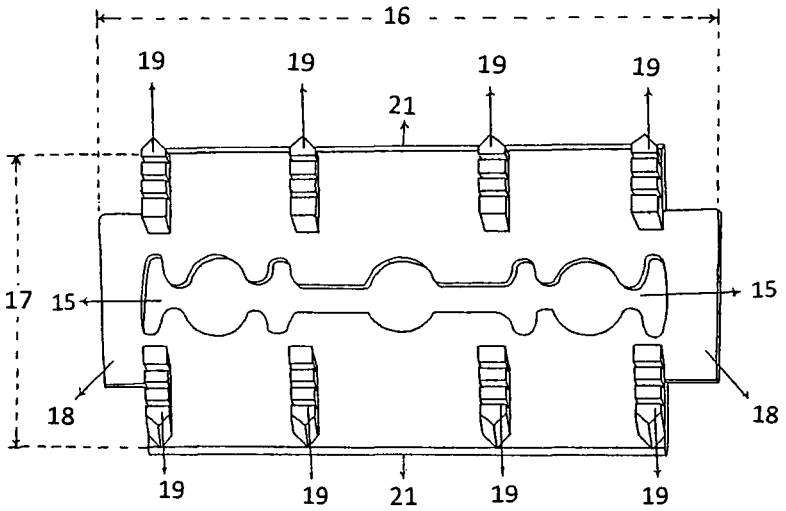
FIG. 2 is a perspective view of a safety razor blade equipped with multiple protuberances which are serial slotted prominences.
Figure 3:
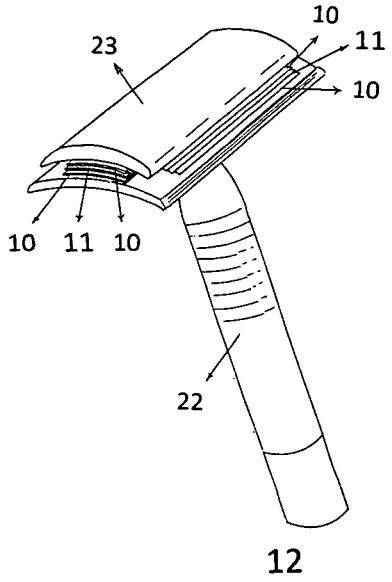
FIG. 3 is a perspective view of a safety razor blade holder stacked with three safety razor blades equipped with multiple protuberances.

Referring now in detail to the drawings, number 10 of FIGS. 1 and 3 is a safety razor blade equipped with multiple protuberances (abbreviated as razor blade 10 hereafter). Numeral 11 of FIGS. 2 and 3 is a safety razor blade equipped with multiple protuberances, wherein the protuberances are serial slotted prominences (abbreviated as razor blade 11 hereafter). Number 12 of FIG. 3 is a safety razor blade holder stacked with three safety razor blades equipped with multiple protuberances, two of razor blade 10 and one of razor blade 11. Number 13 of FIG. 1 is thin blade of razor blade 10. Thin blade 13 is as thin as a conventional safety razor double-edged blade. Number 14 of FIG. 1 is the built-in protuberance (abbreviated as protuberance 14 hereafter), which is an elongated prominence and preferably made of flexible material. There are preferably four protuberances 14, as illustrated in FIG. 1. Each protuberance 14 is approximate 1/16 inch in height which determines the distance of the space between two razor blades 10 or two razor blades 11, 1/16 inch in width and 4/16 inch in length. Number 15 of FIGS. 1 and 2 is the central cut out of razor blade 10 and razor blade 11. The central cut out 15 is the same as that of a conventional safety razor double-edged blade. Number 16 of FIGS. 1 and 2 is the length of razor blade 10 and razor blade 11. Number 17 of FIGS. 1 and 2 is the width of razor blade 10 and razor blade 11. Number 18 of FIG. 2 is the thin blade of razor blade 11. Thin blade 18 is as thin as a conventional safety razor double-edged blade. Number 19 of FIG. 2 is the built-in protuberance (abbreviated as protuberance 19), which is serial slotted prominences. There are preferably four protuberances 19, as illustrated in FIG. 2. Each protuberance 19 is approximately 1/16 inch height, 1/16 inch in width and 4/16 inch long in length. Number 20 of FIG. 1 is the sharp edge of razor blade 10. The protuberance 14 of FIG. 1 is built transversely at the sharp edge 20 and spaced at a distance from other protuberances 14. Number 21 of FIG. 2 is the sharp edge of razor blade 11. The protuberance 19 of FIG. 2 is built transversely at the sharp edge 21 and spaced at a distance from other protuberances 19. Number 22 of FIG. 3 is a razor blade holder of safety razor blade. Number 23 of FIG. 3 is the cover member of razor blade holder 22. One of the razor blade 11 and two of the razor blade 10 are installed on the razor blade holder 22. The length 16 and the width 17 of razor blade 10 and razor blade 11 are the same as those of a conventional razor double-edged blade. The width 17 of razor blade 10 and razor blade 11 can be varied with gradual narrowing. Therefore, there are wider razor blade 10 and razor blade 11. The narrower razor blade should be superposed on the top of the wider one for easier shaving. In this case, the cover member 23 of razor blade holder 22 should have the same gradual narrowing width corresponding to the width 17 of razor blade 10 and 11.

The invention claimed is:

1. A safety razor comprising two or more double-edge blades stacked on top of each other in a razor holder, wherein each blade comprises a safety razor blade body and two or more protuberances made of flexible material and built transversely at each edge, whereby the protuberances separate said two or more blades, and wherein each protuberance is a serially slotted prominence.

2. The safety razor of claim 1, wherein a narrower razor blade is stacked on top of a wider one for easier shaving.

3. The safety razor of claim 2 comprising three double-edge blades and four protuberances made of flexible material and built transversely at each edge, wherein said protuberances each includes 3 serial slots.

4. The safety razor of claim 1, wherein said protuberances are approximately 1/16 inch in height, 1/16 inch in width and 3/16 inch in length.

* * * * *